United States Patent [19]

Forrest et al.

[11] Patent Number: 4,844,179

[45] Date of Patent: Jul. 4, 1989

[54] DRILL STRING STABILIZER

[75] Inventors: John Forrest, Milltimber; Rory Tulloch, Aberdeen; William Stewart, Cowbog, all of United Kingdom

[73] Assignee: Drilex UK Limited, London, United Kingdom

[21] Appl. No.: 79,779

[22] PCT Filed: Nov. 28, 1986

[86] PCT No.: PCT/GB86/00728

§ 371 Date: Aug. 24, 1987

§ 102(e) Date: Aug. 24, 1987

[87] PCT Pub. No.: WO87/03642

PCT Pub. Date: Jun. 18, 1987

[30] Foreign Application Priority Data

Dec. 6, 1985 [GB] United Kingdom ..... 8530078

[51] Int. Cl.[4] ..... E21B 4/00; E21B 17/10

[52] U.S. Cl. ..... 175/92; 175/325

[58] Field of Search ..... 175/325, 321, 320, 92, 175/107

[56] References Cited

U.S. PATENT DOCUMENTS

| | | | |
|---|---|---|---|
| 3,561,549 | 2/1971 | Garrison et al. | 175/76 |
| 3,642,079 | 2/1972 | Van Note | 175/325 |
| 3,933,395 | 1/1976 | Evans | 175/325 |
| 3,938,853 | 2/1976 | Jurgens et al. | 166/241 X |
| 3,978,933 | 9/1976 | Olson et al. | 175/325 |
| 3,999,618 | 12/1976 | Farris | 175/321 X |
| 4,000,549 | 1/1977 | Brumley et al. | 175/325 X |
| 4,101,179 | 7/1978 | Barron | 175/325 X |
| 4,384,626 | 5/1983 | Derouin | 175/325 X |
| 4,441,565 | 4/1984 | Liejekvist | 175/325 |
| 4,560,013 | 12/1985 | Beingraben | 175/325 |

FOREIGN PATENT DOCUMENTS 2166177 4/1986 United Kingdom .

*Primary Examiner*—Hoang C. Dang

*Attorney, Agent, or Firm*—Bell, Seltzer, Park & Gibson

[57] ABSTRACT

A stabilizer sleeve (7) for a drill string, adapted to fit about a down hole motor (1) or a drill string member, is formed with an internally threaded coupling at a lower end for releasable coupling to complimentary threads (8) formed on an upwardly extending intermediate coupling portion (15) of a bottom coupling-nut (3). The coupling-nut (3) is provided with a lower end portion (14) of larger diameter and an upper coupling portion (16) of reduced diameter. The upper coupling portion (16) is conventionally formed with an upwardly tapering form and right-hand thread whereas the intermediate coupling portion (15) is formed with a left-hand thread. The stabilizer sleeve (7) fits about the motor (1) or other body member and above the coupling-nut (3) so that the sleeve (7) may be removed upwardly from the coupling-nut (3).

6 Claims, 2 Drawing Sheets

DRILL STRING STABILIZER

This invention relates to drill string stabilisers incorporating rig interchangeable sleeves and is particularly, but not exclusively, useful in connection with down-hole motors and/or at the bottom hole assembly of a drill string to assist in directional drilling It is known to provide integral stabilisers and clamp-on type stabilisers. Currently known sleeve type stabilisers are not suitable for attaching to down hole motors or like devices. Integral stabilisers are normally workshop fitted and cannot be removed from a drilling motor whilst at the rig site. Clamp-on stabilisers are designed for removal at the rig site and several prior proposals have met with varying levels of success without having been completely satisfactory.

A clamp-on stabiliser for location at any position in a drill string is disclosed in U.S.-A-No. 4,384,626 and comprises a stabiliser body, an internal gripper sleeve and a lock nut acting to lock the gripper sleeve within the stabiliser body and about the drill string.

Conventional sleeve type string stabilisers are used in a drill string to support the string in the previously drilled hole to prevent contact between the drill string and the bore hole and one embodiment comprises a stabiliser sleeve mounted about the upper end of a drill string tube, complimentary threads of right hand at the upper ends of the sleeve and the drill tube engaging to secure the sleeve to the drill tube against loosening during drilling.

It is an object to provide an improved stabiliser of the sleeve type suitable for use with down hole motors and/or at the bottom hole assembly of a drill string, and elsewhere in the drill string.

According to the invention a stabiliser sleeve for a drill string comprises a sleeve adapted to fit about a down hole motor or the like device or drill string member and formed externally with stabiliser means extending radially outwards for engaging a bore hole wall, the sleeve being formed at a lower end with coupling means adapted for releasable coupling to complimentary coupling means at the lower end of the down hole motor or like device or member.

The down hole motor or like device will generally be formed at its lower end with a bottom nut for releasable coupling to the down-hole motor casing, and the releasable coupling between the stabiliser sleeve and motor or device is suitably formed above the bottom nut and between the sleeve and a bottom nut-forming member. The nut-forming member is suitably formed at its upper end with an external upward right-hand threaded taper engaging a complimentary threaded taper within the lower end of the down hole motor body or other body, and between the uppermost threaded portion and the bottom nut with an intermediate portion, of intermediate diameter and upwardly tapered form having an external left-hand screw thread engageable with a complimentary thread within the lower end of the sleeve to form the releasable coupling.

The above stabiliser is laterally supported by the bottom nut and the down hole motor body and suitably engages the outer wall of the motor body in this regard.

An abutment shoulder flange is suitably formed at the lower end of the intermediate threaded portion of the bottom nut-forming member to engage a complimentary shoulder at the lower end of the stabiliser sleeve.

If a slick assembly is required, i.e. one in which no bottom hole stabilisation is necessary then the stabiliser sleeve may readily be removed and replaced by a reduced diameter protective sleeve matching the outer diameter of the shoulder flange.

A stabiliser sleeve according to the invention may be used with other down hole devices, or sub-assemblies provided at their lower ends with an external shoulder flange and threaded portion for engaging the internal thread portion and shoulder at the lower end of the stabiliser sleeve. This has the advantage that the same motor or down hole device may be used in both directional and slick modes.

The stabiliser sleeve is suitably formed with stabilising means comprising radially outwardly projecting fins which are suitably circumferentially distributed around the sleeve and extend axially thereof. The fins may extend helically.

The invention includes a kit of parts comprising a stabiliser sleeve according to the invention and at least one device for use in a drill string, the device having a body of cylindrical form about which the sleeve may be passed and formed at its lower end with complimentary coupling means to the coupling means of the sleeve.

The invention will now be described, by way of example, with reference to the accompanying partly diagrammatic drawings, in which.

Figure 1:
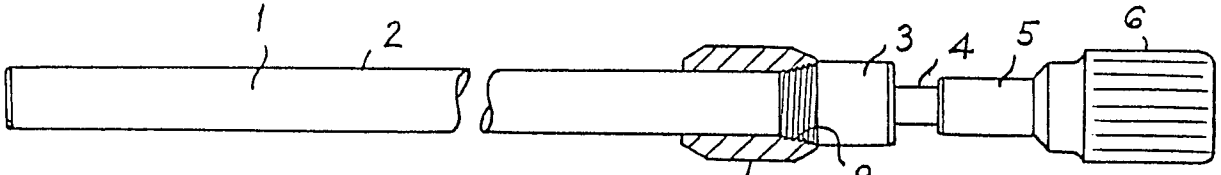
FIG. 1 is a partly sectional side elevation of a bottom hole assembly with a shoulder sleeve attached over a drilling motor.

The assemblies of FIGS. 1 to 4 comprise a down hole motor 1 having an elongate cylindrical body 2 and provided at its lower end with a bottom nut 3 through which an output shaft 4 extends to a bit box 5 for releasable attachment to a drill bit 6 as shown in FIG. 1. A stabiliser sleeve 7 is mounted at the lower end of the motor body 2 above the bottom nut 3 to which it is secured by complimentary screw threads 8.

Figure 2:
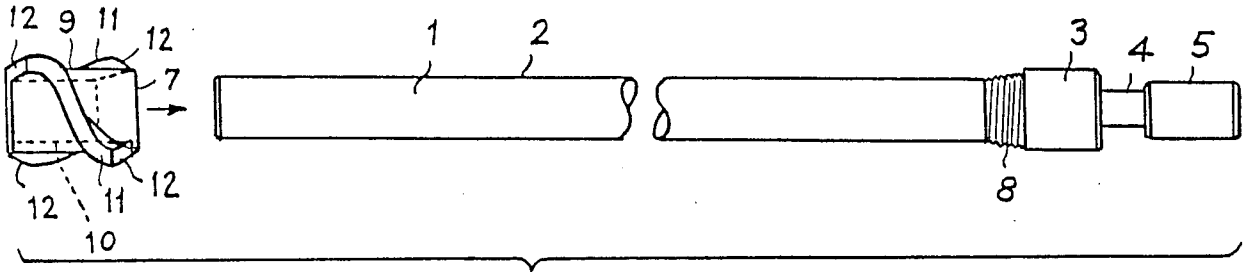
FIG. 2 is an exploded view of part of the assembly of FIG. 1 prior to attachment of the stabiliser sleeve.

The stabiliser sleeve 7, as seen in FIG. 2, comprises a cylindrical body 9 having an inner bore 10 which is a sliding fit over the motor body 2, and is formed externally with a pair of diametrically opposed axially extending part helical ribs 11 with leading and trailing ends 12 chamfered to the body 9. The ribs 11 project radially from the body 9 and apart from the chamfered ends 12 are of uniform height defining a diameter corresponding to the bit 6 bore hole diameter whereby in a drilling operation the ribs 11 engage the bore hole wall to support the drill laterally and avoid contact of the body 1 with the bore hole wall. The outer edges of the ribs 11 are suitably hardened.

The diameter of the ribs 11 can vary according to drilling practice to allow directional control of the bore hole from the surface to be achieved. Similarly the ribs 11 may be provided with an off-set to allow course correction and bore hole deviation to be achieved.

Figure 4:
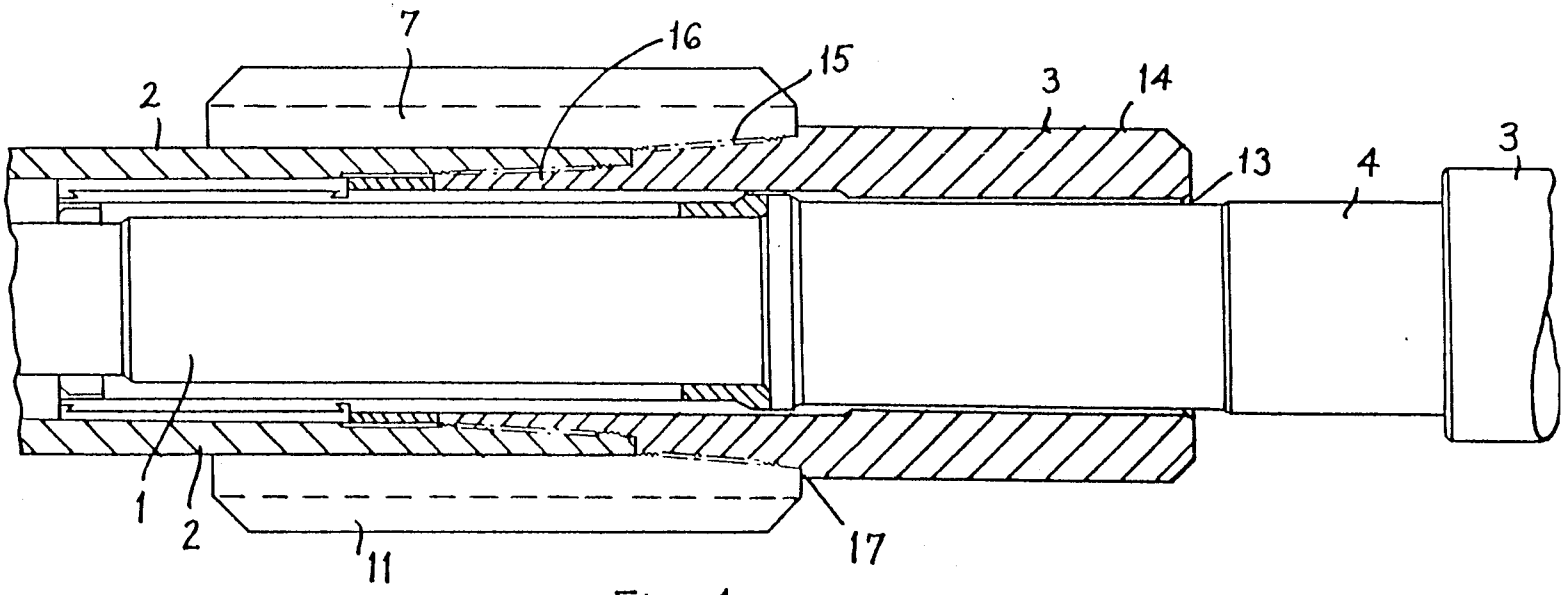
FIG. 4 is a fragmentary sectional elevation of part of the assembly of FIG. 1, to an enlarged scale and at the location of the stabiliser sleeve.

As shown in FIG. 4 the bottom nut 3 comprises a cylindrical body having a bore 13 through which the output shaft 4 extends, and comprises a lower nut portion 14 and an intermediate portion 15 of reduced diameter and an upper end portion 16 of further reduced diameter. Both portions 15 and 16 are upwardly tapered, the upper end portion 16 being externally threaded in right-hand fashion, whereas the intermediate portion 15 is threaded in left-hand fashion. The stabiliser sleeve 7 is slidably engaged about the motor body 2 above the bottom nut 3 from the position shown in FIG. 2 to that shown in FIG. 1 until the threads of the intermediate portion 15 engage the threaded portion 8 of the bottom nut 3 above the nut portion 14. The sleeve threads are then tightened to engage the leading end of the sleeve 7 against an upwardly facing annular shoulder 17 formed between the nut portion 14 and the reduced diameter intermediate portion 15.

By virtue of the left hand thread engagement between the stabiliser sleeve 7 and the bottom nut 3 loosening of the sleeve 7 relative to the nut 3 during a drilling operation is avoided.

In order to remove the sleeve 7 the coupling between the down hole motor 1 and the drill string may be released at the well head, the thread coupling between the sleeve 7 and the bottom nut 3 disengaged, and the sleeve 7 withdrawn upwardly from the motor 1. This sleeve 7 of different drill-bore diameter may readily be positioned about the motor body 2.

Figure 3:
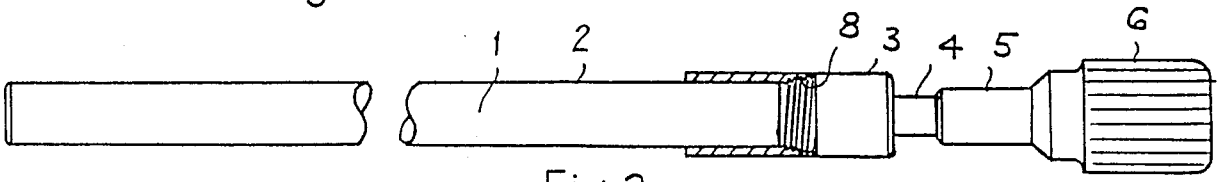
FIG. 3 is a partly sectional elevation of the assembly of FIG. 1 modified as a slick assembly.

Should it be desired to operate the motor 1 in a slick assembly, as shown in FIG. 3, the threaded portion 8 of the nut 3 is suitably protected by a threaded sleeve 18 of outer diameter matching that of the nut shoulder 17.

Whilst the invention has been described particularly in connection with a down-hole motor, it may be used at other locations in a drill string by using a drill string member or cross-over sub-assembly having a lower end formed to provide an abutment shoulder below an upwardly tapering threaded portion extending radially outwards of an upper body of the member or sub-assembly in the manner of threaded portion 8 and shoulder 17.

We claim:

1. A down hole drilling device comprising an elongate cylindrical body (2) having upper and lower ends and coupled at its lower end to a bottom nut (3), a stabiliser sleeve (7) mounted about said cylindrical body (2) and above said bottom nut (3) and being releasably coupled at the lower end thereof to the upper end of said bottom nut (3), said bottom nut (3) comprising a lower nut forming portion (14) and an upper coupling portion including an upper external right-hand threaded taper (16) engaging a complimentary threaded taper within the lower end of said cylindrical body (2), and an intermediate upwardly tapered left-hand threaded coupling portion (15) positioned between said upper external threaded taper (16) and said lower nut forming portion (14) and engaging a complimentary threaded taper within the lower end of said stabiliser sleeve (7) to thereby permit upward removal of said stabiliser sleeve (7) from said bottom nut (3).

2. A down hole drilling device according to claim 1 wherein said elongate cylindrical body (2) comprises a down hole motor (1).

3. A down hole drilling device according to claim 1 wherein said stabiliser sleeve (7) is laterally supported by said bottom nut (3) and said elongate cylindrical body (2) and engages an outer wall of said elongate cylindrical body (2).

4. A down hole drilling device according to claim 1 including an upwardly facing abutment shoulder flange (17) formed at the lower end of said intermediate upwardly tapered left-hand threaded coupling portion (15) of said bottom nut (3) and engages a complimentary shoulder at the lower end of said stabiliser sleeve (7).

5. A down hole drilling device according to claim 1 and wherein said stabiliser sleeve (7) is formed with stabilising means comprising radially outwardly projecting fins (11, 12) which are circumferentially distributed around said stabiliser sleeve (7) and extend axially thereof.

6. A down hole drilling device according to claim 5 in which said fins (11, 12) extend helically.

* * * * *